US006628256B2

(12) United States Patent
Nishimura

(10) Patent No.: US 6,628,256 B2
(45) Date of Patent: Sep. 30, 2003

(54) DRIVE CIRCUIT OF A LIQUID CRYSTAL DISPLAY DEVICE

(75) Inventor: Mitsuhisa Nishimura, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 172 days.

(21) Appl. No.: 09/726,418

(22) Filed: Dec. 1, 2000

(65) Prior Publication Data

US 2001/0002829 A1 Jun. 7, 2001

(30) Foreign Application Priority Data

Dec. 3, 1999 (JP) ..... 11-345344

(51) Int. Cl.[7] ..... G09G 3/36; G09G 5/00

(52) U.S. Cl. ..... 345/96; 345/94; 345/98; 345/87; 345/204

(58) Field of Search ..... 345/204, 96, 94, 345/98, 99

(56) References Cited

U.S. PATENT DOCUMENTS 5,856,816 A * 1/1999 Youn ..... 345/98
5,986,648 A * 11/1999 Okada et al. ..... 345/204
6,008,801 A * 12/1999 Jeong ..... 345/204
6,191,768 B1 * 2/2001 Imamura ..... 345/98
6,229,513 B1 * 5/2001 Nakano et al. ..... 345/99
6,348,915 B1 * 2/2002 Yamashita et al. ..... 345/204

FOREIGN PATENT DOCUMENTS

JP 11-259050 9/1999
JP 11-282421 10/1999

OTHER PUBLICATIONS

Japanese Office Action dated Nov. 12, 2002, with partial English translation.

* cited by examiner

*Primary Examiner*—Steven Saras
*Assistant Examiner*—Michael J Moyer
(74) *Attorney, Agent, or Firm*—McGinn & Gibb, PLLC

(57) ABSTRACT

The present specification discloses a drive circuit of a liquid crystal display device that transfers image data to a liquid crystal panel which is able to reduce the amount of change of the value of each bit of data that may be transferred over a bus line. In the case the number of data signals that cause a polarity change in the output to a bus line is equal to or greater than the majority of data signals for each of four output ports, a controller inverts the polarity of the data signals, and outputs data from each output port to the bus line. In addition, the controller outputs polarity inversion signals, which indicate that the polarity of data signals output to the bus line has been inverted, for each output port.

20 Claims, 11 Drawing Sheets

FIG. 7

| n | 1 | 2 | 3 | 4 | 5 | ····· | 22 | 23 | 24 |
|---|---|---|---|---|---|---|---|---|---|
| dan | H | H | L | H | H | ····· | H | H | H |
| dcn | H | L | H | L | L | ····· | H | L | H |
| An | L | H | H | H | H | ····· | L | H | L |

FIG. 8A

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | L | L | L | L | L | H | H | H | H | H | L | L | L | L | L | L | L |
| Zn | H | H | H | H | H | H | H | L | L | L | L | L | H | H | H | H | H | L | L | L | L | L | L | L |

FIG. 8B

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | L | L | L | L | L | H | H | H | H | H | L | L | L | L | L | L | L |
| Zn | L | L | L | L | L | L | L | H | H | H | H | H | H | H | H | H | H | L | L | L | L | L | L | L |

FIG. 8C

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | H | L | L | L | L | H | H | H | H | L | L | L | L | L | L | L | L |
| Zn | L | L | L | L | L | L | L | L | H | H | H | H | H | H | H | H | L | L | L | L | L | L | L | L |

FIG. 8D

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | H | H | L | L | L | H | H | H | L | L | L | L | L | L | L | L | L |
| Zn | L | L | L | L | L | L | L | L | L | H | H | H | H | H | H | L | L | L | L | L | L | L | L | L |

DRIVE CIRCUIT OF A LIQUID CRYSTAL DISPLAY DEVICE

BACKGROUND OF THE INVENTION

1. Field of the Invention

The present invention relates to a liquid crystal display device used for the display device of a computer and so forth, and more particularly, to a drive circuit of a liquid crystal display device suitably used for the drive circuit of a liquid crystal panel.

2. Prior Art

In recent years, liquid crystal display devices using liquid crystal panels which are able to comparatively effectively realize brightness and high resolution more than cathode ray tubes (CRTs), have come to be used as display devices of computers, portable terminals and so forth.

FIG. 10 is a block diagram showing the configuration of a drive circuit of the prior art that drives a liquid crystal panel of a liquid crystal display device. In this drawing, 1 is a liquid crystal panel that displays images, 101 is a controller that outputs image data displayed by liquid crystal panel 1 from one port in the form of 48-bit data BUS1 to 48 via a 48-bit bus line, and 102-m (m is an integer of 1 or more) is a source driver (abbreviated as SD) that drives liquid crystal panel 1 by generating drive signals for displaying images from data BUS1 to 48 output by this controller 101.

Furthermore, the following explanation is given for the case of m, which indicates the number of this SD, being 10. In addition, SD102-5 through SD102-10 are not shown in FIG. 10.

Data BUS1 to 24 output by controller 101 shown in FIG. 10 are connected to each odd-numbered SD102-1, 3, 5, 7 and 9 among SD102-1 through SD102-10. Similarly, clock CLK3 and control signal SP3 output by controller 101 are also connected to each odd-numbered SD102-1, 3, 5, 7 and 9.

On the other hand, data BUS25 to 48 output by controller 101 are connected to each even-numbered SD102-2, 4, 6, 8 and 10 of SD102-1 through SD102-10, and similarly, clock CLK4 and control signal SP4 output by controller 101 are also connected to each even-numbered SD102-2, 4, 6, 8 and 10.

Furthermore, a breakdown of the respective 24-bit signals of the above data BUS1 to 24 and data BUS25 to 48 consists of red (R), green (G) and blue (B) signals of 8 bits each, and a color display of 256 gradations is realized by these R, G and B signals.

In this drive circuit of a liquid crystal display device of the prior art composed in this manner, each odd-numbered SD102-1, 3, 5, 7 and 9 respectively latches data BUS1 to 24 output from controller 101 in synchronization with clock CLK3 at the time of control signal SP3. On the other hand, each even-numbered SD102-2, 4, 6, 8 and 10 respectively latches data BUS25 to 48 output from controller 101 in synchronization with clock CLK4 at the time of control signal SP4.

Next, each SD102-1 through SD102-10 generates a drive signal based on latched data BUS1 to 24 or BUS25 to 48, respectively, when each drive starting signal (not shown), which designates the start of driving to liquid crystal panel 1, is input. When a drive signal generated by each of these SD102-1 through SD102-10 is input to liquid crystal panel 1, an image is displayed on that liquid crystal panel 1.

Furthermore, there are fixed limitations on the frequencies of input clocks CLK3 and 4, which are the transfer frequencies of image data, for SD102-1 through SD102-10 that drive liquid crystal panel 1. In order to lower the transfer frequency of image data to equal to or less than that limiting frequency, the bus line that transfers image data from controller 101 to each SD102-1 through SD102-10 is divided into 24 bits each, and transfers image data to each odd-numbered SD102-1, 3, 5, 7 and 9, and each even-numbered SD102-2, 4, 6, 8 and 10, respectively.

However, in the drive circuit of a liquid crystal display device of the prior art described above, if the amount of change in the value of each bit of data BUS1 to 48 transferred on the bus lines is excessively large, the problem results in which the power consumption of the drive circuit of the liquid crystal display device becomes large.

In addition, the bus lines that transfer data BUS1-48 becomes long since they run in the horizontal direction around liquid crystal panel 1. In addition, since the number of bus lines is also large, there are cases in which antenna effects result. Consequently, if the amount of change in the value of each bit of data BUS1 to 48 transferred on that bus line is excessively large, electromagnetic interference noise that is radiated due to the changes in the value of each bit also becomes large resulting in poor electromagnetic interference (EMI) characteristics. Since this radiated electromagnetic interference can cause erroneous operation and have other detrimental effects on surrounding electronic equipment, poor EMI characteristics of liquid crystal display devices used in the vicinity of precision electronic equipment or in computer rooms and so forth can present an extremely serious problem.

Moreover, it is necessary to use expensive anti-EMI components to reduce radiation of this electromagnetic interference, which in turn increases the cost of liquid crystal display devices.

Moreover, it is difficult to determine whether or not this radiated electromagnetic interference is noise that originates in the bus line, and being unable to identify the cause of its radiation is also a problem.

In addition, in the case of a large amount of change in the values of each bit of data BUS1-48, cross-talk noise occurs between bus lines resulting in the problem of causing data errors.

SUMMARY OF THE INVENTION

The present invention takes into consideration these circumstances, and its object is to provide a drive circuit of a liquid crystal display device that transfers image data to a liquid crystal panel which is able to reduce the amount of change in the values of each bit of data transferred over bus lines.

In order to solve the above problems, a first exemplary embodiment of the invention is a drive circuit of a liquid crystal display device having a bus line of a width equal to the number of transfer data signals and to which is output a plurality of transfer data signals; equipped with: a data polarity inversion judgment device, which outputs a polarity inversion signal indicating that the plurality of data signals are output to the bus line after inverting the polarity of all the signals in the case the majority or more of a plurality of data signals output to the bus line as the plurality of transfer data signals cause a polarity change in the output to the bus line; and, a polarity inversion device that inverts the polarity of all of the plurality of data signals that are input and outputs the signals as the plurality of transfer data signals corresponding to the polarity inversion signal output from the data polarity inversion judgment device.

In a second exemplary embodiment, the above data polarity inversion judgment device and the above polarity inversion device are respectively equipped for a plurality of bus lines.

In a third exemplary embodiment, a drive circuit of a liquid crystal display device having a bus line of a width equal to the number of transfer data signals and to which is output a plurality of transfer data signals; equipped with: a first latching circuit that latches a plurality of input data signals in synchronization with an input clock and outputs signals in the form of a plurality of first data signals; a polarity inversion circuit that inverts the polarity of all of the plurality of first data signals and outputs the signals in the form of a plurality of second data signals in the case an input first polarity inversion signal is at a predetermined inversion designation level; a data polarity inversion judgment circuit that outputs a second polarity inversion signal in the form of the inversion designation level in the case the number of corresponding plurality of input data signals and plurality of second data signals having different polarity is greater than or equal to the majority of the signals; and, a second latching circuit that latches the second polarity inversion signal in synchronization with the input clock, and outputs the signal in the form of the first polarity inversion signal.

A fourth exemplary embodiment is equipped with: a third latching circuit that latches that plurality of second data signals in synchronization with the input clock and outputs the signals in the form of the plurality of transfer data signals; and, a fourth latching circuit that latches the first polarity inversion signal in synchronization with the input clock and outputs the signal in the form of a third polarity inversion signal.

In a fifth exemplary embodiment the above first to fourth latching circuits, the above polarity inversion circuit and the above data polarity inversion judgment circuit are respectively equipped for a plurality of bus lines.

In a sixth exemplary embodiment the phase of the above input clock corresponding to half the number of the plurality of bus lines, and the phase of the above input clock corresponding to the other half of the number of the plurality of bus lines are out of phase by one half cycle.

BRIEF DESCRIPTION OF THE DRAWINGS

FIG. 7 is a table for explaining the operation of polarity changing and detection circuit 21 shown in FIG. 6.

FIGS. 8A to 8D are tables for explaining the effect obtained by the first embodiment shown in FIG. 1.

DETAILED DESCRIPTION OF THE PREFERRED EMBODIMENTS

The following provides an explanation of a first embodiment of the present invention with reference to the drawings.

Figure 1:
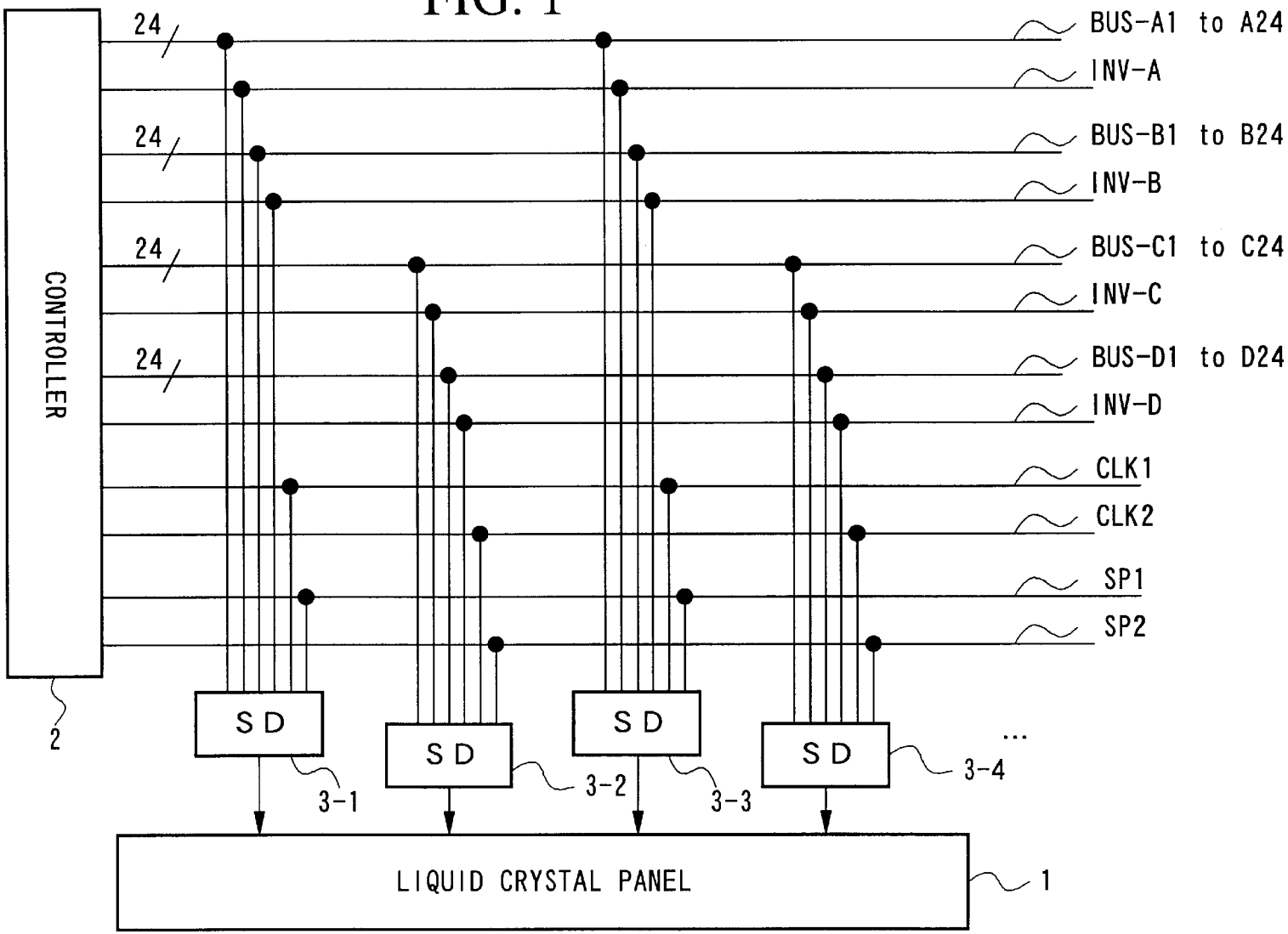
FIG. 1 is a block diagram showing the configuration of a drive circuit of a liquid crystal display device according to a first embodiment of the present invention.

FIG. 1 is a block diagram showing the configuration of a drive circuit of a liquid crystal display device according to this first embodiment. In this drawing, 1 is a liquid crystal panel that displays images, and 2 is a controller that outputs image data displayed by liquid crystal panel 1 by dividing among four ports in the form of data BUS-A1 to A24, BUS-B1 to B24, BUS-C1 to C24 and BUS-D1 to D24 of 24 bits each, and controls that image display, and 3-m (where m is an integer of 1 or more) is a source driver (abbreviated as SD) that drives liquid crystal panel 1 by generating drive signals for displaying images from data BUS-A1 to A24, BUS-B1 to B24, BUS-C1 to C24 and BUS-D1 to D24 output by controller 2. SD3-m, which drives this liquid crystal panel 1, generates each drive signal corresponding to a plurality of pixel displays with a single SD, and images are displayed as a result of the entire liquid crystal panel 1 being driven by m number of SD3-m. For example, in the first embodiment shown in FIG. 1, liquid crystal panel 1 has 1280 pixels, the number of pixels driven by a single SD is 128, and m, which indicates the number of SD, is 10. Among these 10 SD3-1 through SD3-10, 3-1 is the first SD, 3-2 is the second SD, 3-3 is the third SD and 3-4 is the fourth SD. The fifth through tenth SD, namely SD3-5 through SD3-10, are not shown. Furthermore, since each SD3-1 through SD3-10 drives the three primary colors of red (R), green (G) and blue (B) per pixel, the number of outputs per SD becomes 3×128=384. In FIG. 1, however, those 384 outputs are represented with a single line.

Data BUS-A1 to A24 and data BUS-B1 to B24 output by controller 2 shown in FIG. 1 are each connected to odd-numbered SD3-1, 3, 5, 7, and 9 among SD3-1 through SD3-10 through respective 24-bit width bus lines. Similarly, polarity inversion signals INV-A and INV-B as well as clock CLK1 and control signal SP1, which are output by controller 2, are also connected to each odd-numbered SD-1, 3, 5, 7 and 9.

On the other hand, data BUS-C1 to C24 and BUS-D1 to D24, which are output by controller 2, are each connected to even-numbered SD3-2, 4, 6, 8 and 10 among SD3-1 through SD3-10 through respective 24-bit width bus lines. Similarly, polarity inversion signals INV-C and INV-D as well as clock CLK2 and control signal SP2, which are output by controller 2, are also connected to each even-numbered SD-2, 4, 6, 8 and 10.

Furthermore, in the above first embodiment shown in FIG. 1, the number of driven pixels per clock of clock CLK1 or clock CLK2 is two, and each clock frequency is reduced by half by assigning the output of two ports each to each odd-numbered SD3-1, 3, 5, 7 and 9 and each even-numbered SD3-2, 4, 6, 8 and 10. For example, in SD3-1, the data of data BUS-A1 to A24 and data BUS-B1 to B24 are supplied to two pixels each simultaneous to one clock time period of clock CLK1.

In addition, a breakdown of each 24-bit signal of the above data BUS-A1 to A24, BUS-B1 to B24, BUS-C1 to C24 and BUS-D1 to D24 consists of red (R), green (G) and blue (B) signals of 8 bits each, and a color display of 256 gradations is realized by these R, G and B signals.

Next, an explanation is provided of the operation by which liquid crystal panel 1 is driven and images are displayed in the drive circuit of a liquid crystal display device having the configuration shown in the above FIG. 1.

To begin with, data BUS-A1 to A24 and BUS-B1 to B24 and polarity inversion signals INV-A and INV-B, which are output from controller 2 in synchronization with clock CLK1, are respectively input to each odd-numbered SD3-1, 3, 5, 7 and 9, and those input signals are latched at the timing of similarly input control signal SP1. This latched polarity inversion signal INV-A indicates whether or not the polarity of similarly latched data BUS-A1 to A24 is inverted, while latched polarity inversion signal INV-B indicates whether or not the polarity of similarly latched data BUS-B1 to B24 is inverted. Next, each SD3-1, 3, 5, 7 and 9 inverts the polarity of data BUS-A1 to A24 and BUS-B1 to B24 corresponding to these latched polarity inversion signals INV-A and INV-B.

On the other hand, data BUS-C1 to C24 and BUS-D1 to D24 and polarity inversion signals INV-C and INV-D, which are output from controller 2 in synchronization with clock CLK2, are respectively input to each even-numbered SD3-2, 4, 6, 8 and 10, and those input signals are latched at the timing of similarly input control signals SP2. This latched polarity inversion signal INV-C indicates whether or not the polarity of similarly latched data BUS-C1 to C24 is inverted, while latched polarity inversion signal INV-D indicates whether or not the polarity of similarly latched data BUS-D1 to D24 is inverted. Next, each SD3-2, 4, 6, 8 and 10 inverts the polarity of data BUS-C1 to C24 and BUS-D1 to D24 corresponding to these latched polarity inversion signals INV-C and INV-D.

Next, when each drive starting signal (not shown) that designates the start of driving to liquid crystal panel 1 is input, each SD3-1 through SD3-10 generates a drive signal based on each data BUS-A1 to A24 and BUS-B1 to B24 or data BUS-C1 to C24 and BUS-D1 to D24 for which polarity has been inverted or not inverted. When these drive signals generated by each SD3-1 through SD3-10 are input to liquid crystal panel 1, an image is displayed on that liquid crystal panel 1.

Next, an explanation is provided of the constitution of data output unit 4 equipped in the above controller 2 and its operation with reference to FIGS. 2 through 7.

Figure 2:
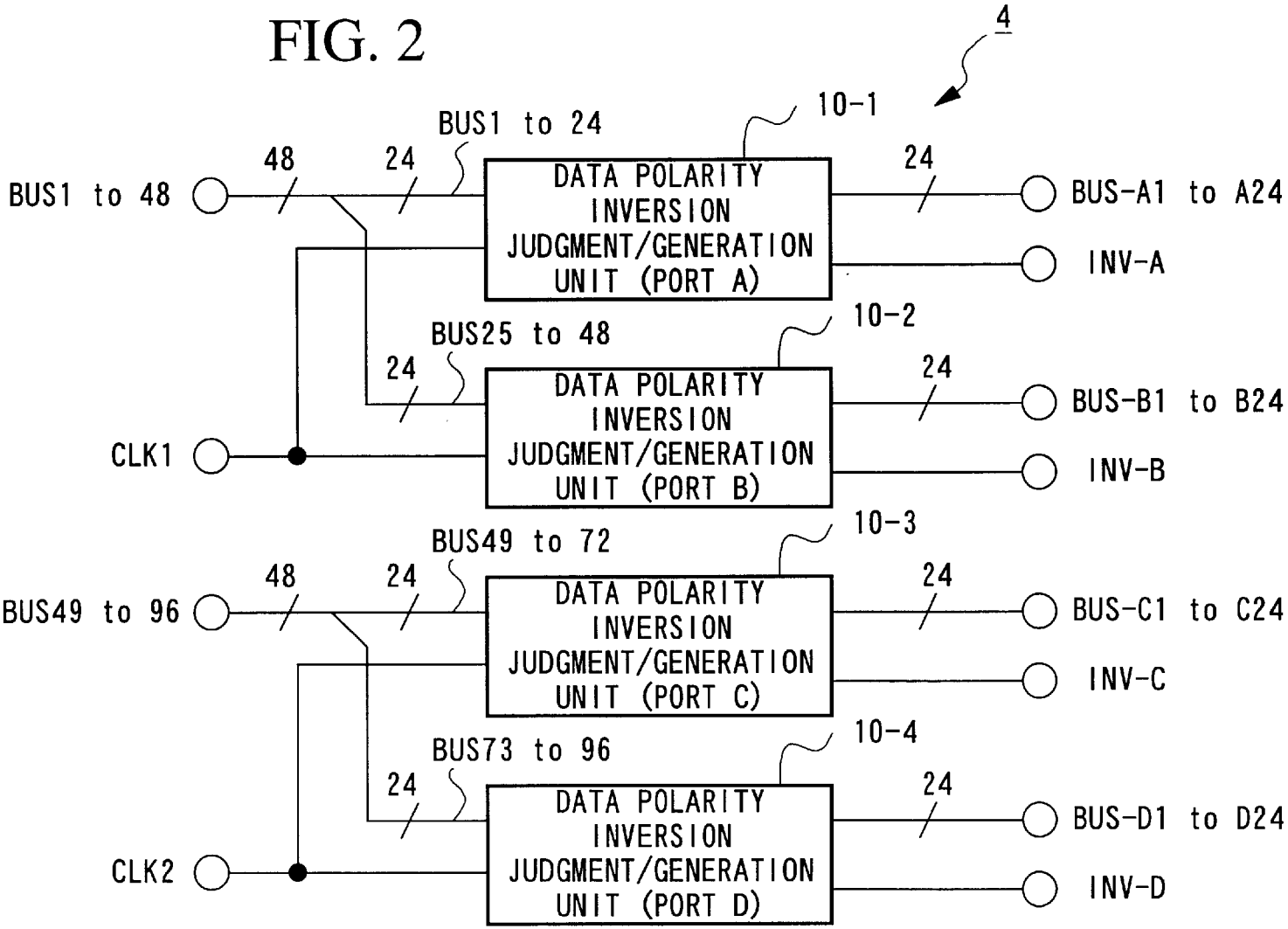
FIG. 2 is a block diagram showing the constitution of data output unit 4 equipped in controller 2 according to the same embodiment.

To begin with, FIG. 2 is a block diagram showing the constitution of data output unit 4 equipped in controller 2. As is shown in this FIG. 2, data output unit 4 has four ports A through D. Each of these ports A–D respectively generate and output each of the signals of data BUS-A1 to A24, BUS-B1 to B24, BUS-C1 to C24, BUS-D1 to D24 and INV-A through INV-D. Signals output from each of these ports A–D are generated by data polarity inversion judgment/generation units 10-1 through 10-4 provided for each port A through D.

96-bit data BUS1 to 96 is input to these data polarity inversion judgment/generation units 10-1 through 10-4 after dividing into four groups of 24 bits each. Among this data BUS1 to 96 divided into four groups, data BUS1 to 24 is input to data polarity inversion judgment/generation unit 10-1, data BUS25 to 48 is input to data polarity inversion judgment/generation unit 10-2, data BUS49 to 72 is input to data polarity inversion judgment/generation unit 10-3, and data BUS73 to 96 is input to data polarity inversion judgment/generation unit 10-4. In addition, clock CLK1 is input to data polarity inversion judgment/generation units 10-1 and 10-2, and clock CLK2 is input to data polarity inversion judgment/generation units 10-3 and 10-4. These clocks CLK1 and CLK2 are output from controller 2 as previously described.

Next, data polarity inversion judgment/generation unit 10-1 of port A judges whether or not to invert the polarity of data BUS1 to 24, inverts data polarity according to this judgment result, and outputs the result in the form of data BUS-A1 to A24. Moreover, when the polarity of this output data BUS-A1 to A24 is inverted, polarity inversion signal INV-A, which indicates that polarity has been inverted, is simultaneously output as "H". In addition, each of data polarity inversion judgment/generation units 10-2 through 10-4 of the other ports B–D similarly judges whether or not to invert the polarity of respectively input data BUS24 to 48, BUS49 to 72 and BUS73-96, inverts data polarity according to those judgment results, and outputs the result in the form of data BUS-B1 to B24, BUS-C1 to C24 and BUS-D1 to D24. In addition when the polarity of these output data BUS-B1 to B24, BUS-C1 to C24 and BUS-D1 to D24 is inverted, polarity inversion signals INV-B through INV-D output by each port B–D are simultaneously and respectively output as "H".

Figure 3:
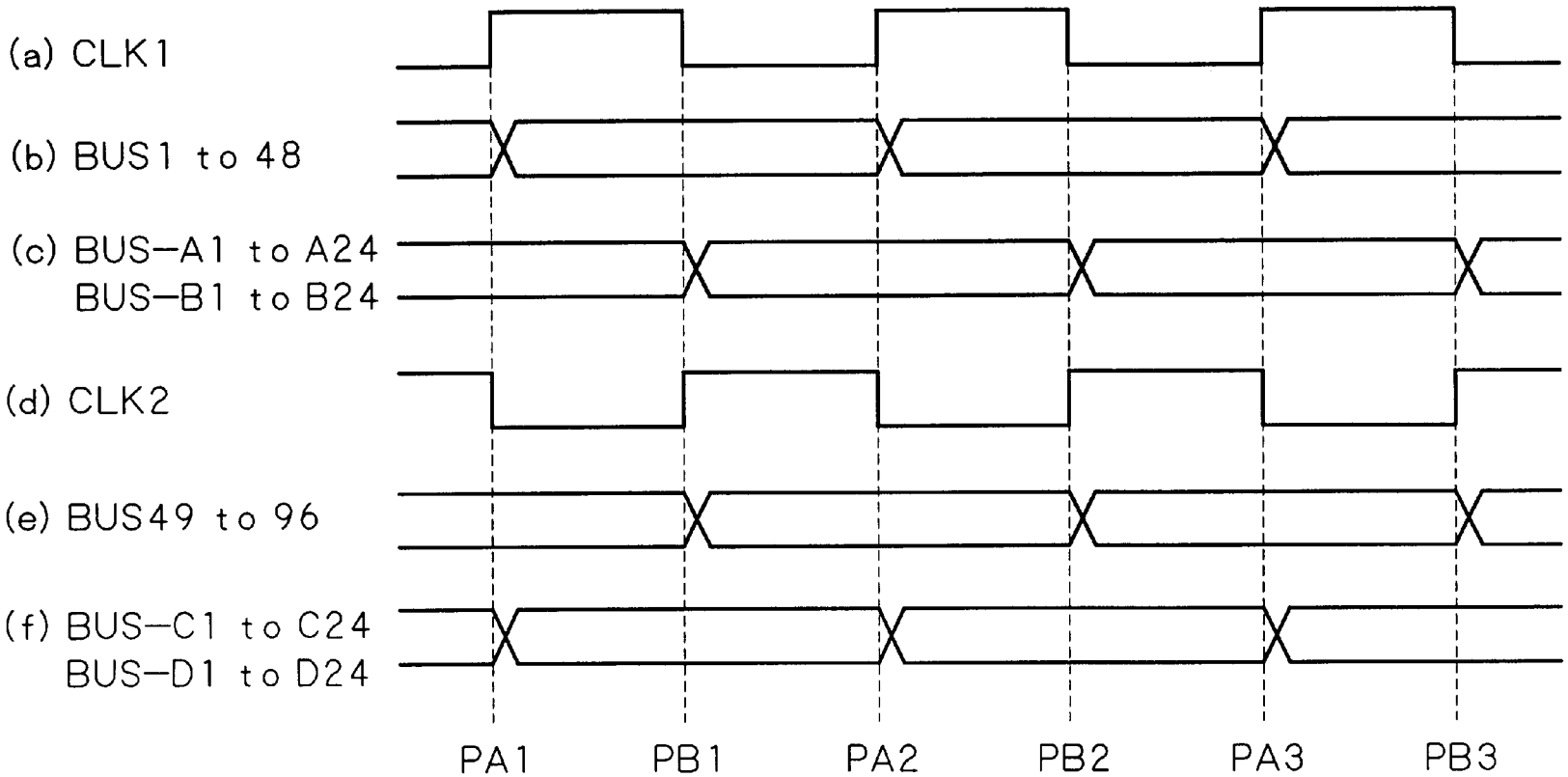
FIG. 3 is a waveform drawing showing the phase relationship between input and output signals of data output unit 4 shown in FIG. 2.

FIG. 3 is a waveform drawing showing the phase relationship among the above clocks CLK1 and CLK2, and data BUS1 to 96, BUS-A1 to A24, BUS-B1 to B24, BUS-C1- to 24 and BUS-D1 to D24. As shown in FIGS. 3(*a*) through (*c*), data BUS1 to 48 changes in synchronization with the rising edge of clock CLK1 (at the timing of PA1-3 in FIG. 3), while data BUS-A1 to A24 and BUS-B1 to B24 change in synchronization with the falling edge of clock CLK1 (at the timing of PB1-3 in FIG. 3). On the other hand, as is shown in FIGS. 3(*d*) through (*f*), data BUS49 to 96 changes in synchronization with the rising edge of clock CLK2 (at the timing of PB1-3 in FIG. 3), while data BUS-C1 to C24 and BUS-D1 to D24 changes in synchronization with the falling edge of clock CLK2 (at the timing of PA1-3 in FIG. 3). In addition, as is shown in FIGS. 3(*a*) and 3(*d*), the phase of clock CLK1 and the phase of clock CLK2 are out of phase by one half cycle (180°).

However, as was previously described, although data BUS1-96 is output from controller 2 after dividing among four ports A through D, the momentary current of controller 2 becomes large if these ports A–D change and output each signal at the same timing. In order to resolve this problem, the phase of clock CLK1 and the phase of clock CLK2 are shifted out of phase by one half cycle as mentioned above, resulting timing by which the change in output of ports A and B is shifted by one half cycle from the change in output of ports C and D. By shifting each change in output of ports A and B and ports C and D in this manner, the output changes simultaneously for two ports at the most even in the case of output by dividing among four ports A through D. Consequently, the momentary current of controller 2 can be held to about the same level as the momentary current in the case of output with two ports.

Figure 4:
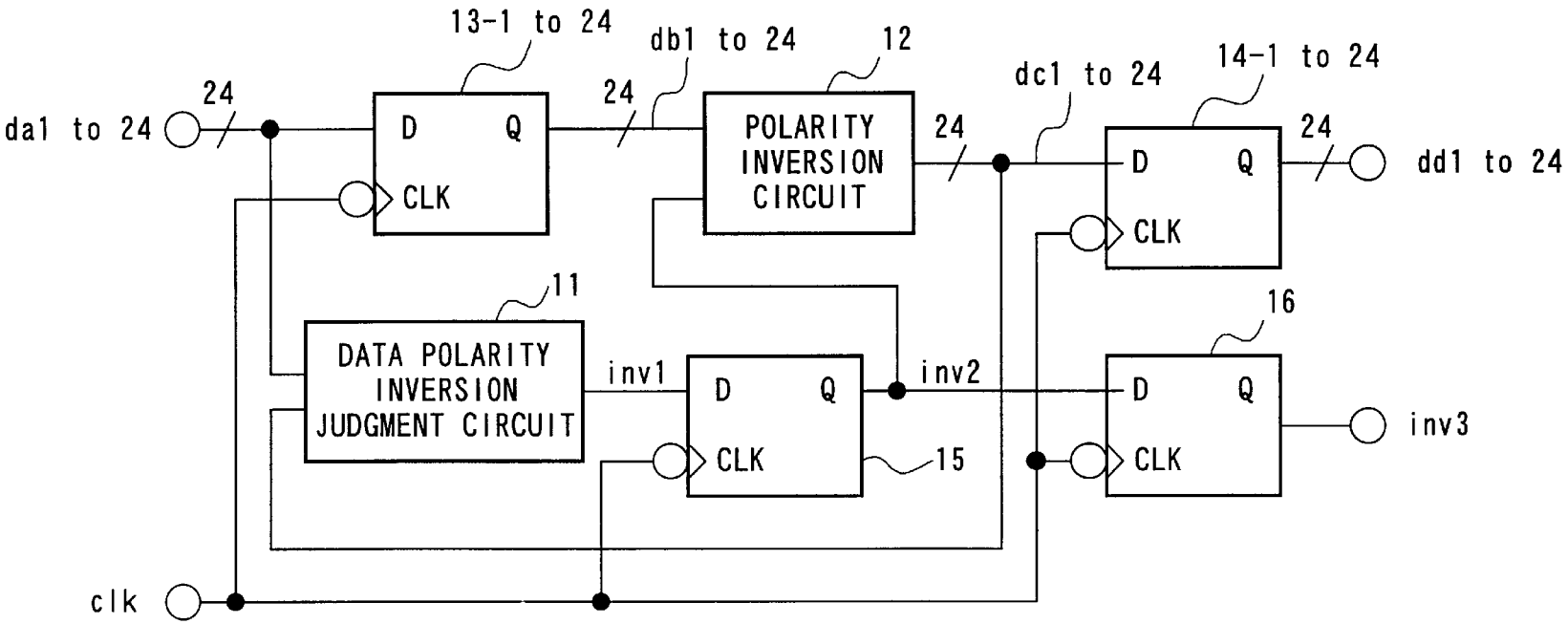
FIG. 4 is a block diagram showing an example of the constitution of data polarity inversion judgment/generation units 10-1 through 10-4 shown in FIG. 2.

Next, an explanation is provided of the constitution and operation of data polarity inversion judgment/generation units 10-1 through 10-4. FIG. 4 is a block diagram showing one example of the composition of any one of data polarity inversion judgment/generation units 10-1 through 10-4.

Data polarity inversion judgment/generation units 10-1 through 10-4 all have the same constitution.

In FIG. 4, data BUS1 to 24, BUS25 to 48, BUS49 to 72 and BUS73 to 96, which are input to each data polarity inversion judgment/generation unit 10-1 through 10-4 in FIG. 2 are input data da1-24, while clocks CLK1 and CLK2 are input clock clk. In addition, output data dd1-24 is data BUS-A1 to A24, BUS-B1 to B24, BUS-C1 to C24 and BUS-D1 to D24 output from each data polarity inversion judgment/generation unit 10-1 through 10-4, and output signal inv3 is polarity inversion signals INV-A through INV-D. 11 is a data polarity inversion judgment circuit that outputs as "H" signal inv1 that designates inversion of data polarity in the case the number of bits having different values among each of the 24 bits of data da1 to 24 and data dc1 to 24 is greater than the majority of bits (13 bits or more), and 12 is polarity inversion circuit that inverts and outputs the polarity of all bits of data db1-24 input during the time input signal inv2 is "H". 13-1 through 13-24 are D flip-flops that respectively latch input data da1-24 at the rising and falling edges of clock clk and then output in the form of data db1 to 24, and 14-1 through 14-24 are D flip-flops that respectively latch input data dc1 to 24 at the rising and falling edges of clock clk and then output in the form of data dd1-24. 15 and 16 are D flip-flops that latch each input signal inv1 and inv2 at the rising and falling edges of clock clk, and respectively output in the form of signals inv2 and inv3.

Figure 5:
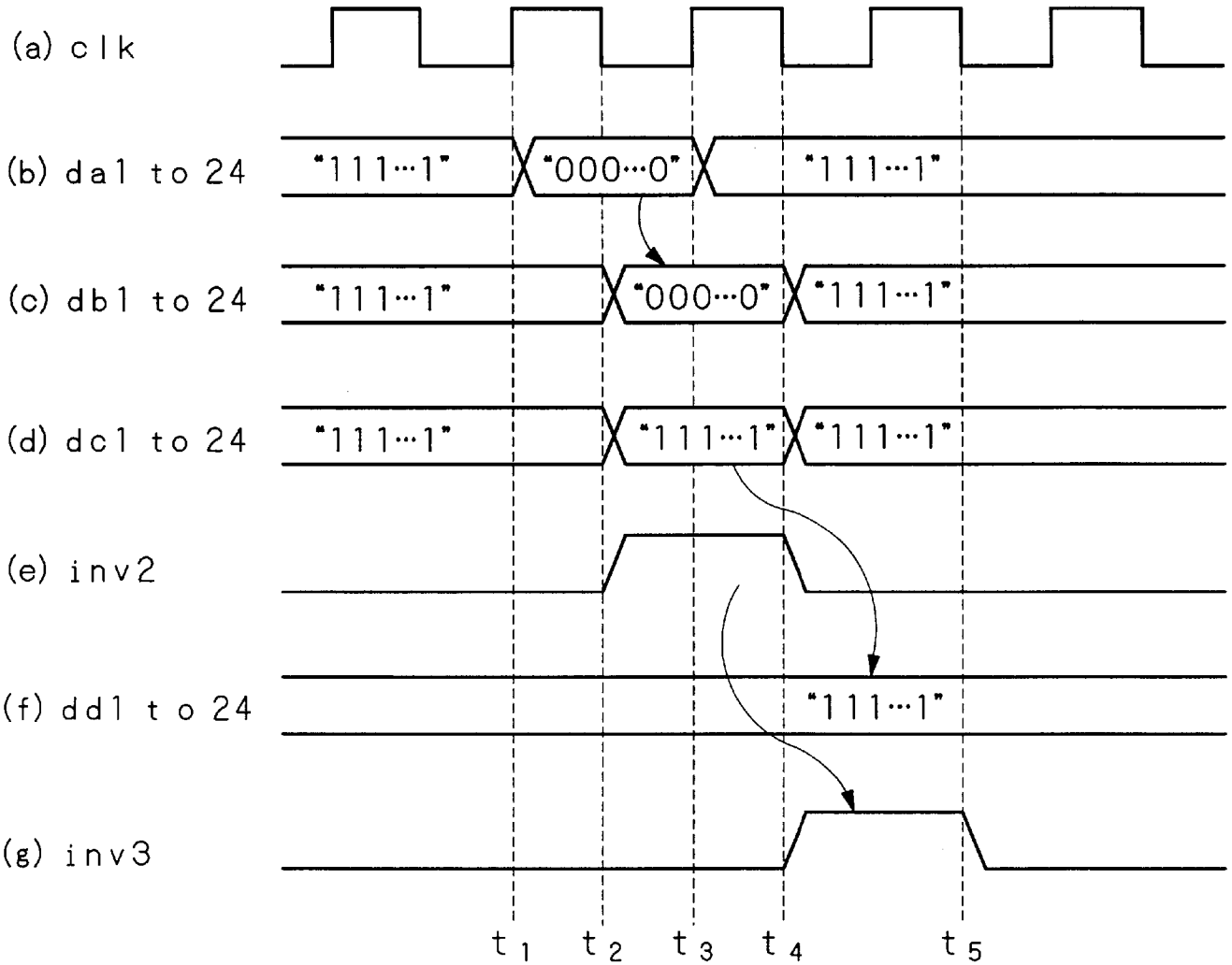
FIG. 5 is a waveform drawing showing the operation of the data polarity inversion judgment/generation units shown in FIG. 4.

FIG. 5 is a waveform drawing showing the waveforms of each data polarity inversion judgment/generation unit 10-1 through 10-4 shown in the above FIG. 4. Here, input clock clk is shown in FIG. 5(*a*), while input data da1 to 24 is shown in FIG. 5(*b*). As is shown in FIG. 5(*b*), initially all 24 bits of input data da1 to 24 are 1, all 24 bits change from 1 to 0 at the timing of rising edge t1 of clock clk, and then all 24 bits change from 0 to 1 at the timing of rising edge t3. When data da1-24 that changes in this manner is input, the output of D flip-flops 13-1 through 13-24 have the waveform shown in FIG. 5(*c*), all 24 bits change from 1 to 0 at the timing of falling edge t2 of clock clk, and then all 24 bits change from 0 to 1 at the timing of falling edge t4.

FIG. 5(*d*) shows the waveform of output data dc1 to 24 of polarity inversion circuit 12, and all bits of data db1 to 24 input during the time output signal inv2 of D flip-flop shown for the waveform of FIG. 5(*e*) are inverted from 0 to 1 and output by polarity inversion circuit 12. When data da1 to 24 of FIG. 5(*b*) and data dc1 to 24 of FIG. 5(*d*) are input to data polarity conversion circuit 11, the number of bits that are different from data dc1 to 24 exceeds the majority of bits as a result of all bits of data da1 to 24 becoming 0 at the timing of t1, and data polarity inversion circuit 11 outputs signal inv1 as "H". D flip-flop 15 latches the "H" signal of signal inv1 output from this data polarity inversion circuit 11 at the timing of t2, and outputs "H" to signal inv2. Next, the number of bits that differ from data dc1 to 24 exceeds the majority of bits as a result of all bits of data da1 to 24 becoming 1 at the timing of t3, and data polarity inversion circuit 11 outputs signal inv1 as "L", which is then latched by D flip-flop 15 at the timing of t4 resulting in signal inv2 becoming "L".

FIG. 5(*f*) shows the waveform of data dd1 through dd24 output by D flip-flops 14-1 through 14-24, data dc1 to 24 shown in FIG. 5(*d*) is latched and output at the timing of the falling edge of clock clk, and all bits remained unchanged at 1. In addition, FIG. 5(*g*) shows the waveform of signal inv3 output by D flip-flop 16, and this signal inv3 becomes "H" during the timing of t4 to t5 at which the polarity of input data da1-24 is inverted from 0 to 1 and output to data dd1-24.

Figure 6:
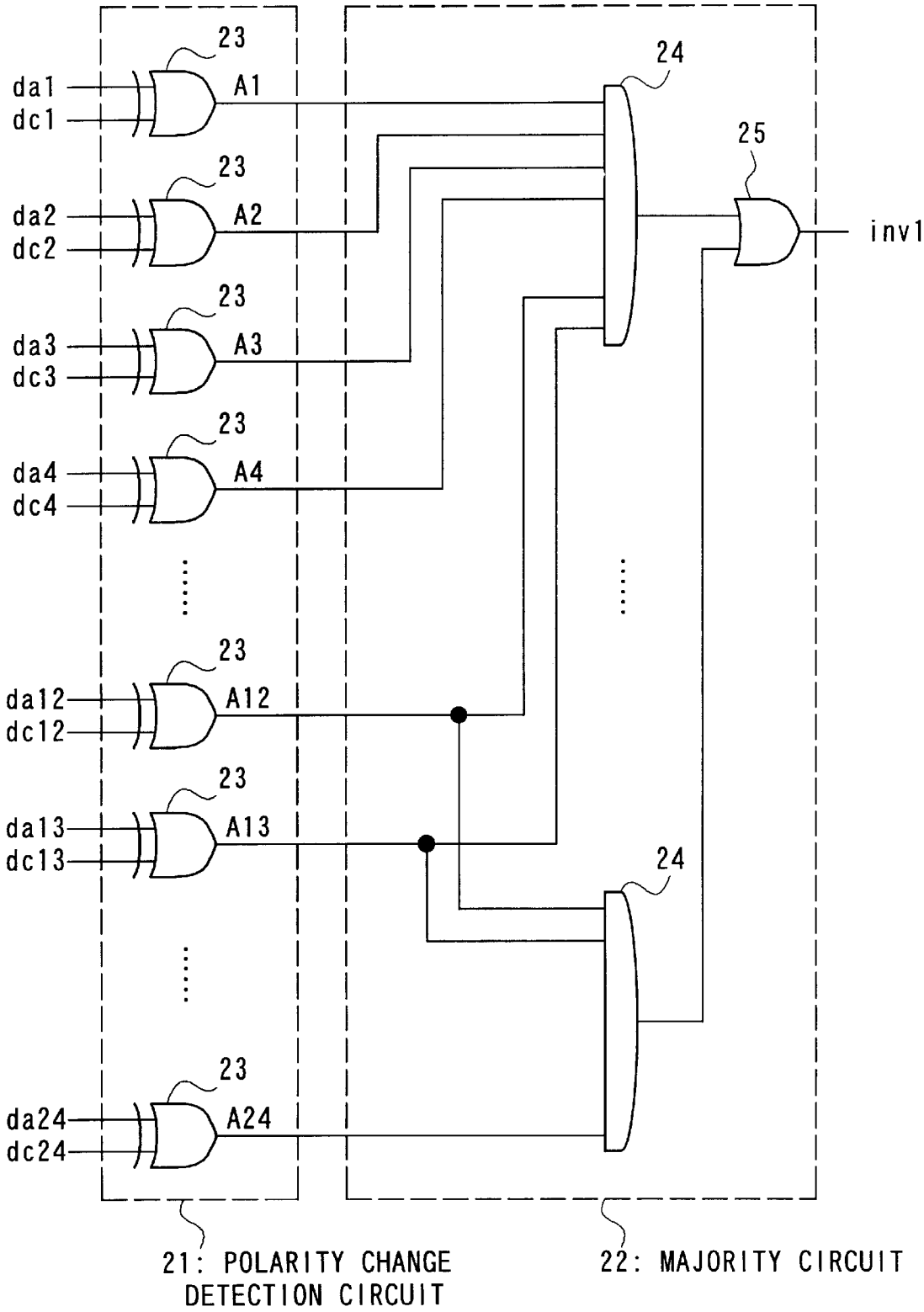
FIG. 6 is a circuit drawing showing an example of the configuration of data polarity inversion judgment circuit 11 shown in FIG. 5.

Next, FIG. 6 is a circuit drawing showing an example of the configuration of data polarity inversion judgment circuit 11. In this drawing, 21 is a polarity change detection circuit, composed of 24 EOR (Exclusive OR) circuits 23, that detects a change in the polarity of each bit from data dc1 to 24 to data da1 to 24 by obtaining the exclusive logical sum for each pair of bits corresponding to data da1 to 24 and data dc1 to 24 of FIG. 4. 22 is a majority circuit composed of 13 input AND circuits 24, equal to the number of combinations, which obtain a logical product by selecting 13 outputs of the 24 EOR circuits 23, and OR circuit 25, which obtains a logical sum for all of the outputs of these 13 input AND circuits 24. This majority circuit switches output signal inv1 to "H" in the case the number of outputs of outputs A1 to 24 of polarity change detection circuit 21 that are "H" is greater than or equal to 13, which is the majority, or switches output signal inv1 to "L" in the case the number of outputs is 12 or less, which is less than the majority.

FIG. 7 is a table for explaining the operation of polarity change detection circuit 21. The first row indicates each bit number n of input data da1 to 24, dc1 to 24 and output A1 to 24 of polarity change detection circuit 21 (n is an integer of 1 to 24), while the second to fourth rows are examples of data dan, dac and output An of EOR circuit 23 corresponding to each bit number n. In this table, since the values of data dan and dac of 23 are different for bit numbers 2–5, the value of output An of 23 becomes "H" for bit numbers 2–5 that correspond to the bits for which these values are different. In the case the number of bits for which these values are detected to be different in this manner is greater than or equal to the majority of 13, "H" is output for output signal inv1.

FIG. 8 are tables for explaining the effect resulting from dividing the output ports into four ports A through D and inverting data polarity for each port A through D in data output unit 4 described above.

Furthermore, for the sake of convenience in providing the explanation, an explanation is provided for the case of taking the total number of bits of data input to the data polarity inversion judgment/generation unit to be 24, and inverting data polarity for 12 bits at a time by dividing the output ports into two ports.

In FIGS. 8(*a*) through 8(*d*), the first row indicates the bit number n (where n is an integer from 1 to 24) of data shown in the second to fourth lines. The second row indicates output data Xn one clock earlier, the third row indicates the current input data Yn, and the fourth row indicates output data Zn corresponding to the current input data Yn shown in the third row.

Furthermore, the values of data Xn, Yn and Zn in the tables shown in FIGS. 8(*a*) through 8(*d*) are examples, and these tables show the example of the polarity of half, namely 12, of the bits changing among the 24 bits of data Yn relative to data Xn. In addition, the table shown in FIG. 8(*a*) uses one data polarity inversion judgment/generation unit, and is an example of the case of performing data inversion in 24-bit units. The tables shown in FIGS. 8(*b*) through 8(*d*) use two data polarity inversion judgment/generation units, and are examples of dividing 24 bits of data into bit numbers 1-12 and 13-24, and performing data inversion in 12-bit units.

Initially, data Xn of the table shown in FIG. 8(*a*) is all "L", while data Yn is "H" for the 12 bits of bit numbers 1–7 and 13–17. In the case of this FIG. 8(*a*), since a judgment is made as to whether there are data changes in the majority or more of the bits in 24-bit units, since only 12 bits have changed, which is less than the majority, data inversion is not performed, and data Yn becomes output data Zn without being changed. As a result, the amount of change of data output becomes 12 bits, which is the maximum amount of change in the case of performing data inversion in 24-bit units.

Next, data Xn of the table shown in FIG. 8(*b*) is all "L", and data Yn is "H" for the 12 bits of bit numbers 1–7 and 13–17, which is the same as the case of FIG. 8(*a*). However, in the case of FIG. 8(*b*), since a judgment is made as to whether there are data changes in the majority of more of the bits in 12-bit units, data inversion is performed since the judgment results of bit numbers 1–12 reveal changes in 7 bits, which is equal to or greater than the majority. As a result, output data Zn of bit numbers 1–12 is inverted from data Yn. On the other hand, since only 5 bits have changed for bit numbers 13–24, the amount of change does not reach the majority and data inversion is not performed. As a result, the amount of change of data output is a total of 10 bits consisting of the 5 bits of bit numbers 8–12 and the 5 bits of bit numbers 13–17, and the amount of change is 2 bits less than the case of performing data inversion in 24-bit units.

Similarly, in the case of the table shown in FIG. 8(*c*), as a result of data Yn of bit numbers 1–12 being inverted and output as data Zn, the amount of change of this data output is a total of 8 bits consisting of the 4 bits of bit numbers 9–12 and the 4 bits of bit numbers 13–16, and the amount of change is 4 bits less than in the case of performing data inversion in 24-bit units.

Moreover, in the case of the table shown in FIG. 8(*d*), as a result of data Yn of bit numbers 1–12 being inverted and output as data Zn, the amount of change of this data output is a total of 6 bits consisting of the 3 bits of bit numbers 10–12 and the 3 bits of bit numbers 13–15. Thus, the amount of change is 6 bits less than in the case of performing data inversion in 24-bit units, indicating that the amount of change can be reduced to half that in the case of performing data inversion in 24-bit units.

Moreover, although not shown in the drawings, in the case the 12 bits of bit numbers 1–11 and 13 of data Yn are "H", as a result of data Yn being similarly inverted and output as data Zn, the amount of change of this data output is the 2 bits of bit numbers 12 and 13. In addition, in the case the 12 bits of bit numbers 1–12 of data Yn are "H", as a result of data Yn being similarly inverted and output as data Zn, the amount of change of this data output is 0 bits (no change in polarity for the output).

As has been described above, by performing data inversion by dividing 24 bits into two groups of 12 bits each for data input of the amount of change of the same 12 bits, when the maximum amount of change in the case of performing data inversion in 24-bit units is 12 bits, the maximum amount of change in the case of performing data inversion after dividing into two groups is 2 bits. Namely, by performing data inversion by dividing into two groups of 12 bits each, the amount of change of data output can be maximally reduced to 0 d as compared with the case of performing data inversion in 24-bit units.

Furthermore, although an example of making the number of bits of input data 24 and dividing the output ports into two ports was explained for the sake of convenience in the explanation of FIG. 8, the effect of reducing the amount of change of data output can also be obtained in the case of inverting data in 24-bit units by dividing 96 bits of data BUS1-96 among four ports A through D as in the above-mentioned embodiment. In addition, in the above-mentioned embodiment, although a constitution is employed in which data is inverted in units of a total of 24 bits consisting of 8 bits each for R, G and B, a constitution may also be employed in which data inversion is performed in 8-bit units for each color.

Furthermore, although the above-mentioned embodiment indicated the case of displaying 3 colors in 256 gradations, various changes can be made in the number of gradations and number of colors.

In this manner, the effect of reducing power consumption required for data output of data output unit 4 is obtained by reducing the amount of change of data output. As a result of this effect of reducing power consumption, power consumption in a drive circuit of a liquid crystal display device according to the above-mentioned embodiment is reduced by 25% as compared with a drive circuit of a liquid crystal display device of the prior art that does not use a data inversion function.

Moreover, the effect of reducing noise generated due to changes in data output is also obtained.

Figure 9:
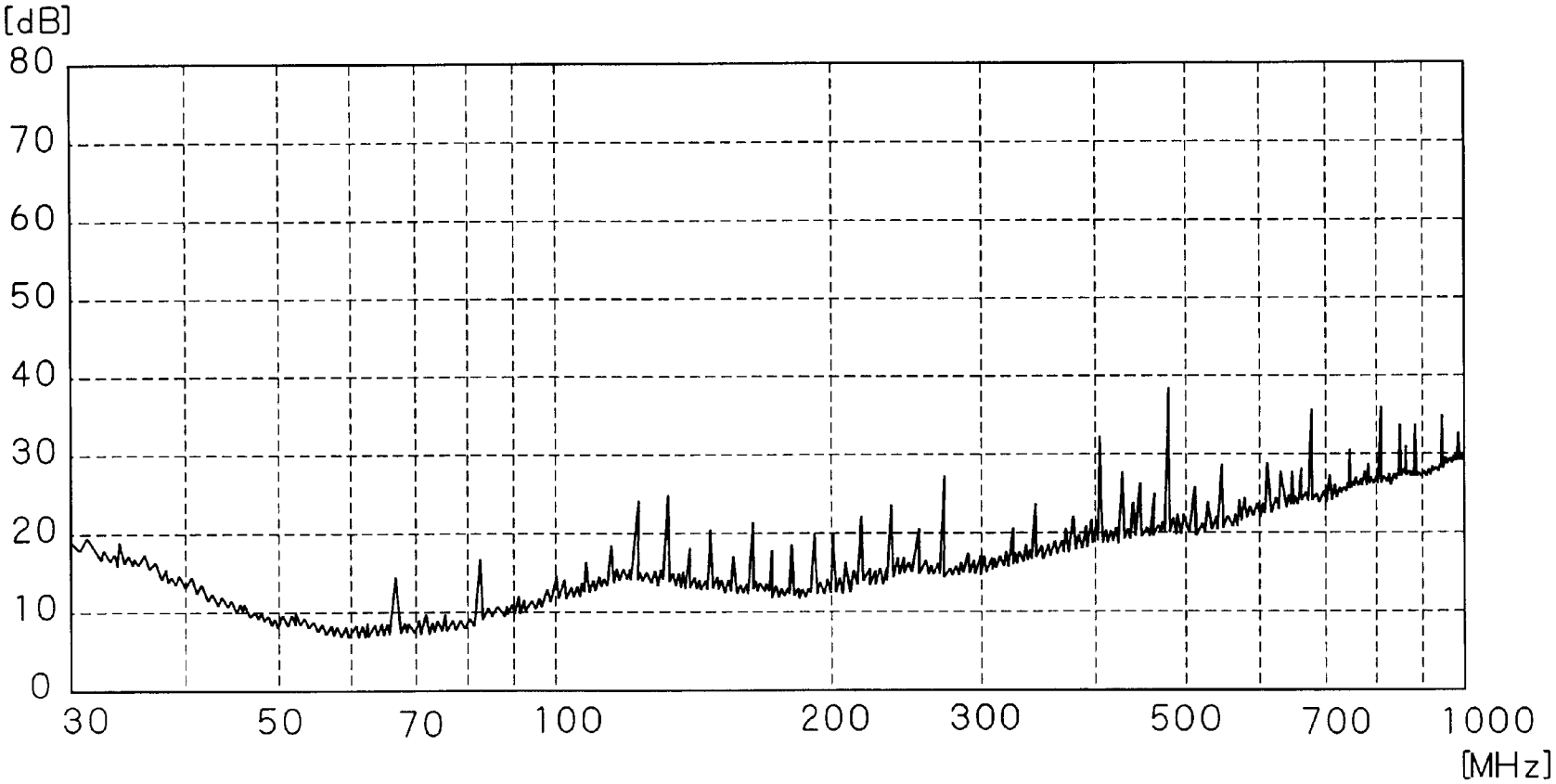
FIG. 9 is a waveform drawing showing the measurement results of EMI characteristics when liquid crystal panel 1 was driven using a drive circuit of a liquid crystal display device according to the first embodiment shown in FIG. 1.
Figure 10:
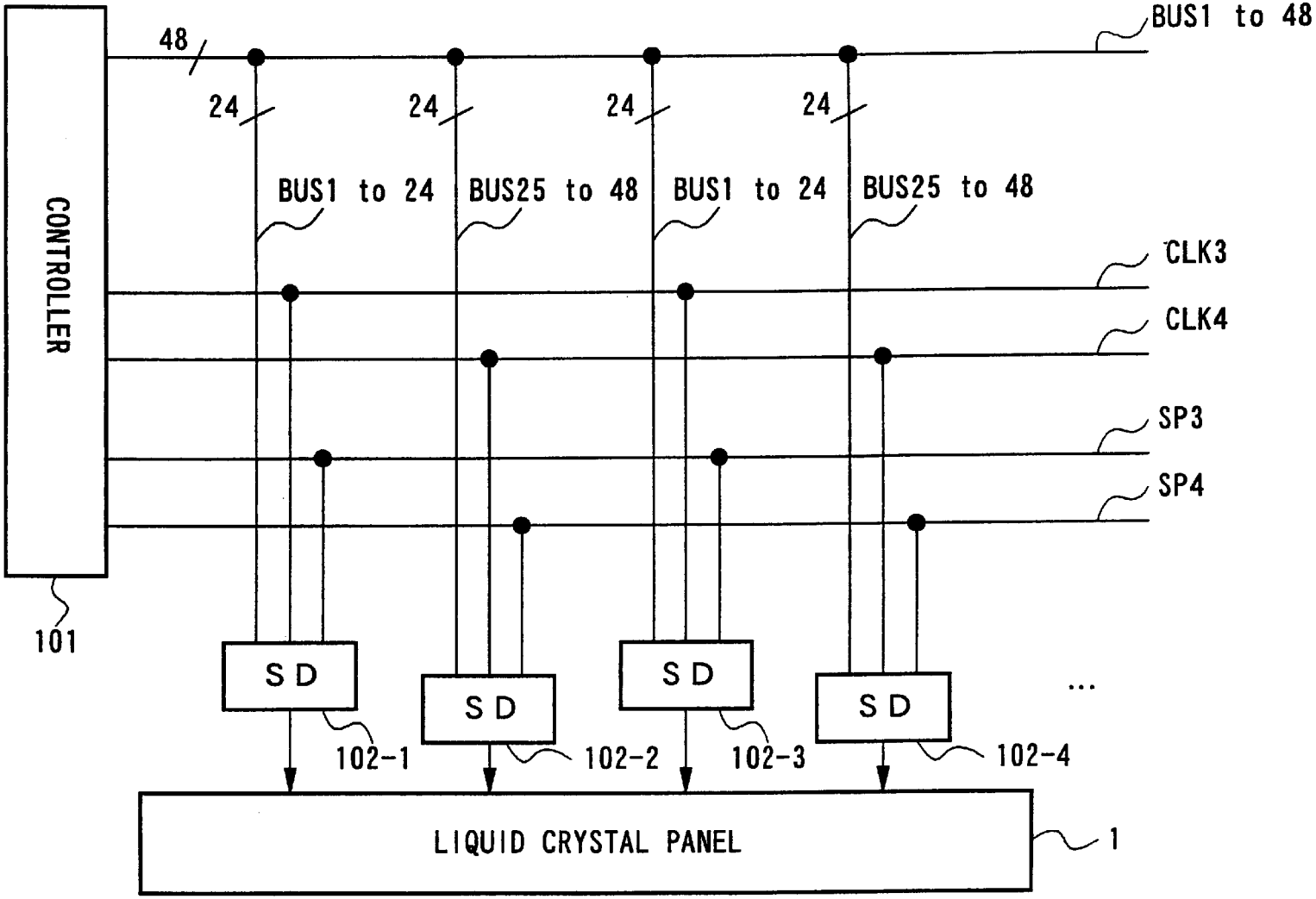
FIG. 10 PRIOR ART
FIG. 10 is a block diagram showing the configuration of a drive circuit of a liquid crystal display device of the prior art.

FIG. 9 is a waveform drawing showing measurement results in which this noise-reducing effect was obtained. The waveform shown in this drawing represents the results of measuring electromagnetic interference noise characteristics (EMI characteristics) when liquid crystal panel 1 was driven using the drive circuit of a liquid crystal display device according to the embodiment described above. Furthermore, in measuring the EMI characteristics shown in FIG. 9, electromagnetic interference noise radiated directly from the drive circuit and liquid crystal panel 1 of the liquid crystal display device was measured after removing the shield plate attached to the liquid crystal display device.

Figure 11:
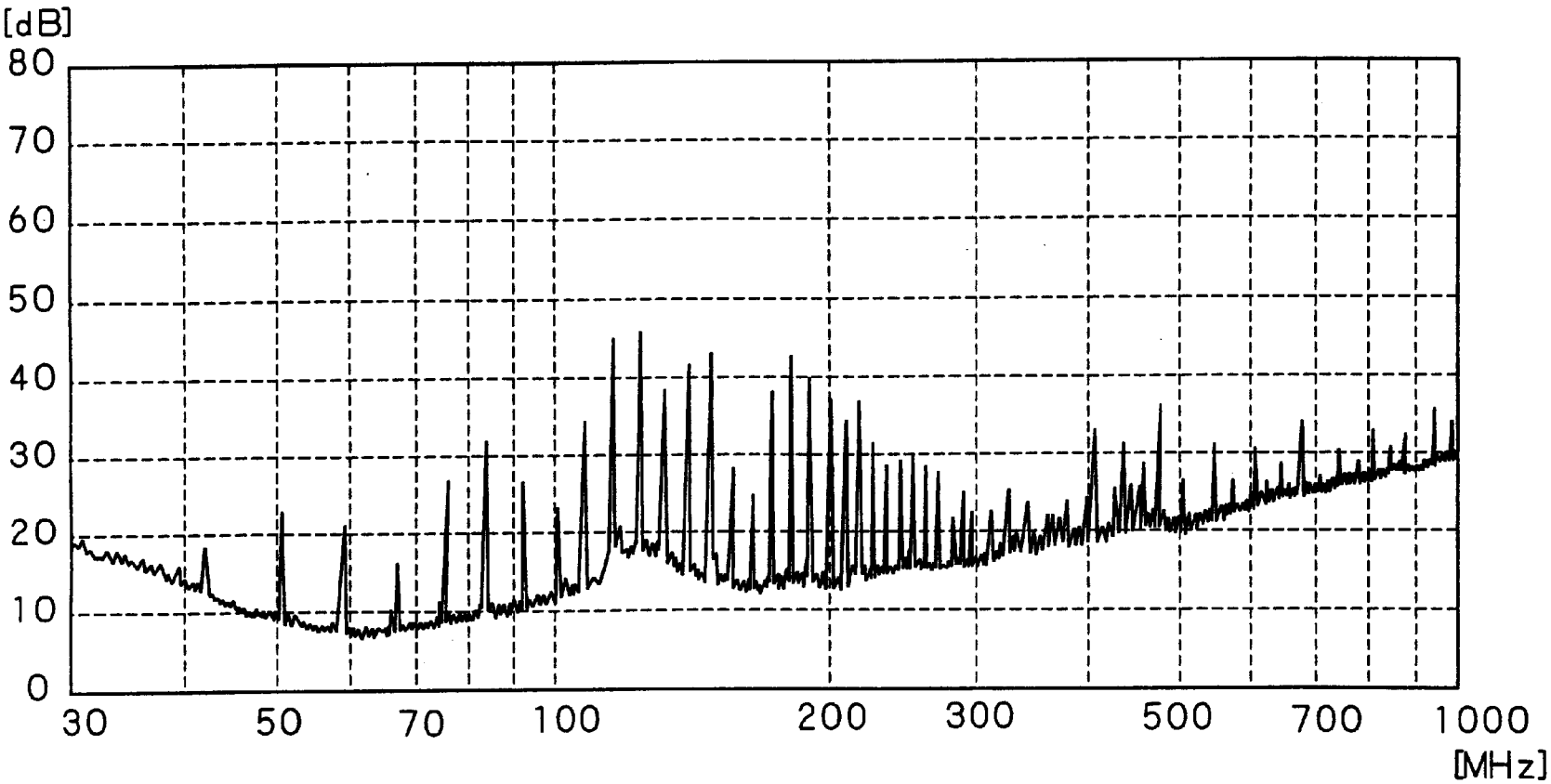
FIG. 11 PRIOR ART
FIG. 11 is a waveform drawing showing the measurement results of EMI characteristics when liquid crystal panel 1 was driven using a drive circuit of a liquid crystal display device of the prior art.

In addition, the waveform shown in FIG. 11 was measured under the same conditions as the measurement of EMI characteristics shown in FIG. 9. This drawing shows the EMI characteristics when liquid crystal panel 1 was driven using a drive circuit of a liquid crystal display device of the prior art not provided with a data inversion function.

In the waveforms shown in FIGS. 9 and 11, the horizontal axis indicates the frequency of the electromagnetic interference noise in megahertz (MHz) units, while the vertical axis indicates the intensity of the electromagnetic interference noise in decibel (dB) units. When the EMI characteristics shown in the waveforms of FIGS. 9 and 11 are compared, the effect was obtained in which electromagnetic interference noise reduction was reduced by 10 dB or more over the frequency band of 40-230 MHz as a result of using the drive circuit of the liquid crystal display device according to the embodiment described above.

Effects of the Invention

As has been explained above, according to the present invention, in the case the number of data signals that cause a polarity change in the output to a bus line is equal to or greater than the majority of data signals in a drive circuit of a liquid crystal display device having a bus line for transferring image data to a liquid crystal panel, the polarity of all data signals is inverted and then output to the bus line. In addition, since a polarity inversion signal, which indicates that the polarity of data signals output to the bus lines is inverted, is also output, the amount of change in polarity of the output to the bus line can be reduced by half or more of the transferred data signals.

As a result, power consumption can be lower than a drive circuit of a liquid crystal display device of the prior art.

Moreover, the effect is also obtained in which EMI characteristics are improved as compared with a drive circuit of a liquid crystal display device of the prior art.

Moreover, since it is no longer necessary to use expensive anti-EMI components, which were required in drive circuits of liquid crystal display devices of the prior art, due to this improvement of EMI characteristics, costs can be reduced as compared with liquid crystal display devices of the prior art.

Moreover, since the frequency at which noise attributable to the bus line is radiated can be determined by comparing EMI characteristics of a liquid crystal display device that uses the present invention and the EMI characteristics of a liquid crystal display device not using the present invention, it is possible to distinguish whether or not electromagnetic interference noise radiated from a liquid crystal display device is noise attributable to the bus line, which was difficult in the prior art.

In addition, the effect is also obtained in which cross-talk noise between bus lines caused by data errors is reduced as a result of reducing the amount of change in polarity of the output to the bus lines.

Moreover, since a data polarity inversion judgment means and polarity inversion means are provided for each bus line, the amount of change in polarity of the output to the bus lines can be further reduced as a result of data polarity being inverted for each bus line.

Moreover, since the clock of half of the bus lines is shifted out of phase by one half cycle from the clock of the other half of the bus lines, it is possible to reduce the amount for which polarity changes simultaneously in the output to the bus lines, thereby allowing momentary current of controller 2 that drives the bus lines to also be reduced.

What is claimed:

1. A drive circuit of a liquid crystal display device having a bus line of a width equal to the number of transfer data signals and to which is output a plurality of said transfer data signals, the circuit comprising:

a data polarity inversion judgment device, which outputs a polarity inversion signal when at least a majority of said plurality of transfer data signals previously output to said bus line have a different polarity than the polarity of said plurality of transfer data signals being input; and, a polarity inversion device that inverts the polarity of said plurality of said transfer data signals that are input in response to said polarity inversion signal output from said data polarity inversion judgment device and output signals as said plurality of said transfer data signals.

2. A drive circuit of a liquid crystal display device according to claim 1 wherein said data polarity inversion judgment device and said polarity inversion device are respectively equipped for a plurality of bus lines.

3. A drive circuit of a liquid crystal display device having a bus line of a width equal to the number of transfer data signals and to which is output a plurality of said transfer data signals, the circuit comprising:

a first latching circuit that latches a plurality of input transfer data signals in synchronization with an input clock and outputs said signals in the form of a plurality of first data signals;

a polarity inversion circuit that inverts the polarity of said plurality of first data signals and outputs said signals as a plurality of second data signals in the case an input first polarity inversion signal is at a predetermined inversion designation level;

a data polarity inversion judgment circuit that outputs a second polarity inversion signal in the form of said predetermined inversion designation level in the case a majority of corresponding said plurality of input transfer data signals and said plurality of second data signals have a different polarity; and, a second latching circuit that latches said second polarity inversion signal in synchronization with said input clock, and outputs said signal in the form of said first polarity inversion signal.

4. A drive circuit of a liquid crystal display device according to claim 3 equipped with:

a third latching circuit that latches said plurality of second data signals in synchronization with said input clock and outputs said signals in the form of said plurality of transfer data signals; and, a fourth latching circuit that latches said first polarity inversion signal in synchronization with said input clock and outputs said signal in the form of a third polarity inversion signal.

5. A drive circuit of a liquid crystal display device according to claim 4 wherein said first to fourth latching circuits, said polarity inversion circuit and said data polarity inversion judgment circuit are respectively equipped for a plurality of bus lines.

6. A drive circuit of a liquid crystal display device according to claim 5 wherein the phase of said input clock corresponding to half the number of said plurality of bus lines, and the phase of said input clock corresponding to the other half of the number of said plurality of bus lines are out of phase by one half cycle.

7. A drive circuit for a liquid crystal display, comprising:

a first polarity inverter that inverts the polarity of a first plurality of input data signals input to said drive circuit in response to a first polarity inversion signal and outputs a first plurality of output data signals; and a first data polarity inversion judgment device that generates said first polarity inversion signal if a majority of said first plurality of input data signals have a different polarity than a first corresponding previously output plurality of output data signals.

8. The circuit of claim 7, wherein said first polarity inverter is adapted for a plurality of bus lines.

9. The circuit of claim 7, wherein said first data polarity inversion judgment device is adapted for a plurality of bus lines.

10. The circuit of claim 7, further comprising a first latching circuit that latches said first plurality of input data signals to a clock signal.

11. The circuit of claim 10, further comprising a second latching circuit that latches said first polarity inversion signal to said clock signal.

12. The circuit of claim 11, further comprising a third latching circuit that latches said first plurality of output data signals to said clock signal.

13. The circuit of claim 12, further comprising a fourth latching circuit that latches said first latched polarity inversion signal from said second latching circuit to said clock signal.

14. The circuit of claim 7, wherein said first data polarity inversion judgment device comprises:

a polarity change detection circuit; and a majority circuit in communication with said polarity change detection circuit which generates said first polarity inversion signal.

15. The circuit of claim 14, wherein said polarity change detection circuit comprises a plurality of exclusive OR circuits that compares each of said first plurality of input data signals with a corresponding one of said first previously output plurality of output data signals.

16. The circuit of claim 15, wherein said majority circuit comprises:

a plurality of AND circuits in communication with said plurality of exclusive OR circuits; and an OR circuit in communication with each of said plurality of AND circuits and which generates said first polarity inversion signal.

17. The circuit of claim 16, wherein said plurality of AND circuits comprise a number of AND circuits equal to a majority of said first plurality of input data signals.

18. The circuit of claim 7, wherein a first half of said first plurality of output data signals are latched to a first input clock signal and wherein a second half of said first plurality of output data signals are latched to a second input clock signal and wherein said first input clock signal and said second input clock signal are 180 degrees out of phase to each other.

19. The circuit of claim 7, wherein said first polarity inverter and said first data polarity inversion judgment device comprise a first data polarity inversion judgment/generation unit.

20. The circuit of claim 19, further comprising a second data polarity inversion judgment/generation unit that outputs a second plurality of output data signals.

* * * * *